US005634481A

United States Patent [19]

Legoupil

[11] Patent Number: 5,634,481

[45] Date of Patent: Jun. 3, 1997

[54] STRIP TREATMENT INSTALLATION

[75] Inventor: Jean-Luc Legoupil, Paris, France

[73] Assignee: Clecim, Cergy Pontoise, France

[21] Appl. No.: 492,674

[22] Filed: Jun. 20, 1995

[30] Foreign Application Priority Data

Jun. 20, 1994 [FR] France ..... 94 07539

[51] Int. Cl.[6] ..... C23G 3/02

[52] U.S. Cl. ..... 134/122 R; 266/112

[58] Field of Search ..... 134/64 R, 64 P, 134/122 R, 122 P; 266/111, 112, 113, 114, 120; 68/175, 181 R

[56] References Cited

U.S. PATENT DOCUMENTS

| | | | |
|---|---|---|---|
| 1,793,914 | 2/1931 | Dorsey . | |
| 2,731,262 | 1/1956 | Morrow . | |
| 2,904,321 | 9/1959 | Bostroem | 266/112 X |
| 3,465,553 | 9/1969 | Muller et al. | 68/175 |
| 3,473,962 | 10/1969 | Hampel | 134/15 |
| 5,248,372 | 9/1993 | McNamee | 134/122 R |

FOREIGN PATENT DOCUMENTS

| | | | |
|---|---|---|---|
| 1253553 | 6/1965 | Germany . | |
| 3429637 | 8/1984 | Germany . | |
| 608903 | 9/1960 | Italy | 134/64 R |
| 93316 | 4/1987 | Japan | 266/111 |

OTHER PUBLICATIONS

Abstracts of Japan, vol. 11, No. 80 (C–409) Inventor: Matsuda Yukio.

Search Report FR 94 07539.

*Primary Examiner*—Philip R. Coe

*Attorney, Agent, or Firm*—Pollock, Vande Sande & Priddy

[57] ABSTRACT

An installation for pickling rolled metal strip in order to remove oxides formed thereon. The strip is fed horizontally through an acid solution bath over a series of deflecting rollers rotating about axes perpendicular to the feed direction of the strip and defining, within a single vessel, outward and return paths comprising at least three superposed sections, and walls dividing the vessel into at least two superposed treatment cells of a height which is low enough for the treatment liquid to be driven along by the feeding of the strip by pumping action.

17 Claims, 2 Drawing Sheets

STRIP TREATMENT INSTALLATION

FIELD OF THE INVENTION

The invention relates to an installation for treating a product in strip form and applies particularly to the pickling of rolled metal strip.

BACKGROUND OF THE INVENTION

During the production of metal strips by rolling, it is necessary to pickle the strips, particularly in order to remove any oxides that may form on their two faces. Generally, the strip is run continuously through an acid solution bath contained in several long, oblong tanks. The horizontally-fed strip passes over a threshold at the upstream end of each tank and enters into the tank forming a loop which dips into the treatment bath. The strip leaves the tank at the other end by passing over a threshold and then dips into the following tank.

In view of the high feeding speed of the strip, a substantial length of it must be immersed, and this is why the strip is made to dip successively into several tanks placed in sequence. The assembly is linked to an acid supply and regeneration circuit which makes it possible to vary the strength of the acid in the tanks from upstream to downstream according to the degree of pickling of the strip.

Such installations are very bulky and difficult and time-consuming to maintain, especially because of the risk of acid corrosion, which calls for regular replacement of certain parts. The bath also gives off acid vapors which can corrode the framework of the building and devices installed in the vicinity of the tanks. While each tank is of course covered by a cover and vapors are collected, the risk of corrosion cannot totally be avoided.

Moreover, a huge amount of acid is consumed because of the large quantities involved and the need to regenerate the acid in order to keep it at the prescribed strength in each tank.

To overcome these drawbacks, JP-A-61.235582 has already proposed replacing the succession of tanks normally used by a closed vessel fitted with deflecting rollers around which the strip passes following a zigzag path, and comprising several superposed "outward" and "return" sections passing between ramps for injecting liquid. While such an arrangement makes it possible to reduce the spatial requirements of the installation, a substantial amount of acid vapor is given off. Moreover, the strip is not immersed in the liquid, which is simply sprayed over each section and drained by gravity.

U.S. Pat. No. 3,473,962 describes another type of zigzag installation in the form of a vessel containing several superposed tanks filled with liquid and associated with deflecting rollers placed at their ends. The strip first passes into a lower tank and travels, at the opposite end, around a deflecting roller whose lower portion dips into the liquid and whose upper portion is placed at the level of the input into the next tank placed above. The strip therefore moves upwards from one tank to the next up to the vessel's output.

The bottom of each tank is inclined in such a way as to ensure that the treatment liquid flows in the direction opposite to the product feed direction. The liquid enters the upper tank at the strip output point and leaves the tank at the opposite end by falling into the tank below it and so on.

Moreover, the fall of the liquid is broken by vertical dividing walls that dip into the liquid, with the resulting turbulence improving the efficiency of the treatment.

However, the liquid can only be renewed slowly since it flows by gravity from one tank to the next, with turbulence being relatively limited.

The object of the invention is also a zigzag installation in which the strip passes into superposed tanks, but one using much simpler arrangements, which considerably reduce the risks of corrosion while considerably improving the efficiency of the treatment.

SUMMARY OF THE INVENTION

According to the invention, the treatment installation comprises:

vessel made up of a bottom, two longitudinal walls, two transverse walls, respectively upside and downside, and a cover, means for controlling the feeding of the strip product in a longitudinal direction, inside the vessel, between an input associated with the upside wall and an output associated with the downside wall, an upside deflector assembly comprising at least two deflecting rollers each mounted so as to rotate about an axis perpendicular to the longitudinal feed direction, respectively a first upside roller placed next to the upside transverse wall and having a lower generating line placed at a first height above the bottom of the vessel and a second roller shifted towards the inside of the vessel and having a lower generating line placed at a second height above the bottom of the vessel, the second height being greater than the first height, a downside deflector assembly comprising at least two deflecting rollers, each mounted so as to rotate about an axis perpendicular to the longitudinal feed direction, respectively a first downside roller placed next to the downside transverse wall and having a lower generating line placed substantially at the first height above the bottom and a second downside roller having a lower generating line placed substantially at the second height above the bottom, the deflecting roller assemblies defining, inside the vessel, an "outward" and "return" path of the strip product comprising at least three superposed sections, extending respectively between the deflecting rollers, respectively a first "outward" section extending at a first horizontal level between the first upside and downside rollers, and a second "return" section extending between the second rollers, respectively upside and downside, and at least a third "outward" section extending between the second upside roller and the output of the vessel, at least two long, oblong, substantially flat separating walls, each extending across the entire width of the vessel between the longitudinal walls, respectively a first wall extending between the first deflecting rollers, at an intermediate level between the first and second sections of the strip, and a second wall extending between the second deflecting rollers, above the second section of the strip, the at least two separating walls dividing the vessel into at least two superposed treatment cells of limited height in which the first "outward" section and the second "return" section of the strip travel respectively, a treatment liquid being introduced into each cell of the vessel, at flow rate and pressure sufficient to completely fill it.

In a particularly advantageous way, the height of each treatment cell is low enough for the treatment liquid to be driven along by the feeding of the strip inside the treatment cell by a pumping action.

According to a first embodiment, the vessel contains a treatment liquid forming a bath up to a level above that of the highest separating wall, such that the inputs of all the treatment cells are immersed in the bath.

Preferably, the diameters of the different rollers are determined in such a way that the lower generating line of each roller is located at the prescribed level for each immersed section and that the axis of rotation of the roller is placed above the surface of the bath.

In a particularly advantageous way, the deflecting rollers placed on the output side of each cell form an obstacle to the evacuation of the liquid capable of producing intense agitation on both sides of the strip, at least at the output of the cell.

According to another particularly advantageous embodiment, each said treatment cell is associated with separate means for introducing a treatment liquid inside the cell, comprising at least one ramp for injecting liquid under pressure, placed at least next to the input of the strip in each cell, and directed towards the inside of the cell, the liquid being carried towards the inside by the feeding of the strip.

According to another essential embodiment, each treatment cell is associated with means for producing a fluid seal at each end of the cell, there means keeping the liquid inside the cell without interfering with the feeding of the strip.

To produce this fluid seal, use is advantageously made at the input and output of each cell of two sets of injection nozzles placed, respectively, below and above the strip and able to inject the treatment liquid towards the inside of the cell, the nozzles placed next to the input of the strip being directed in the feed direction, and those placed next to the output of the strip being directed in the direction opposite to the feed direction.

Due to these arrangements, each cell constitutes a sort of individual tank filled completely with liquid, the liquid being continuously recovered via at least one orifice provided at the level of the cell in at least one of the longitudinal walls, the orifice being linked to a drawing-off circuit determining a rate of recovery from the cell that is equal to the supply rate to the cell.

The treatment liquid can also be laterally introduced into each cell by injection nozzles distributed along the two longitudinal walls at the level of the cell.

In a particularly advantageous way, by providing several superposed cells inside the vessel, each constituting a tank provided with separate means for supplying and recovering liquid, the strength of the treatment liquid injected into each cell can be adjusted to suit the position of the cell on the path of the strip.

BRIEF DESCRIPTION OF THE DRAWINGS

The invention will be better understood from the following description of a number of embodiments of the invention, given by way of example and shown in the accompanying drawings. In these drawings.

DETAILED DESCRIPTION

Figure 1:
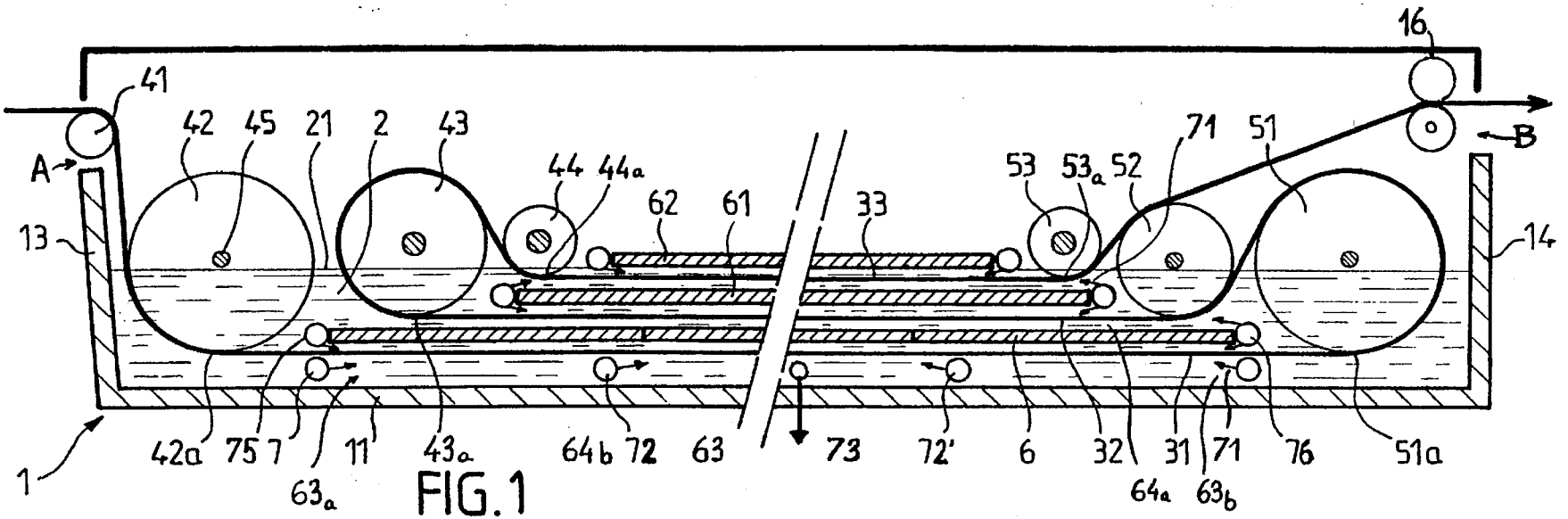
FIG. 1 is a schematic, longitudinal, cross-sectional view of a pickling installation of the invention.

The installation shown in FIG. 1 comprises a vessel 1 defined by a bottom 11, two longitudinal side walls 12, two transverse side walls 13, 14 and a removable cover 15 which rests in a conventional manner on the side walls via an intermediate water seal.

In the embodiment shown in FIG. 1, vessel 1 forms a tank filled with a treatment liquid 2 up to a level 21.

The product to be pickled is presented in the form of a continuous strip 3 associated with means (not shown) designed to feed the strip through the inside of the tank in a longitudinal direction F parallel to side walls 12 of the tank, between an input A and an output B.

According to the invention, vessel 1 is provided with two sets 4, 5 of deflecting rollers placed in position, respectively, at the upstream and downstream ends of the tank.

Strip 3, which arrives from the left in FIG. 1, first passes over rear wall 13 via an input A which may be provided with a threshold forming a rounded guiding surface or else a deflecting roller 41. A second deflecting roller 42 is placed in position below deflecting roller 41, the lower generating line 42*a* of deflecting roller 41 being placed in position a small distance $e_1$ above bottom 11 of vessel 1.

At the opposite end of the vessel, a deflecting roller 51 is fitted, the lower generating line 51*a* of which is arranged substantially at the same level $e_1$ as generating line 42*a* of upside roller 42 in such a way that the strip, which first passes on first deflecting roller 41, is kept taut in the "outward" direction between the two rollers 42 and 51 along a first section 31 parallel to bottom 11 of vessel 1.

The strip travels around a portion of the periphery of roller 51 and is then deflected by a second downside roller 52 whose lower generating line 52*a* is placed at a height $e_2$ above bottom 11, $e_2$ being greater then $e_1$.

The strip thus returns, in the "return" direction, to the upside end 13 of the tank where it travels around a second upside deflecting roller 43 placed at the same level as downside roller 52, in such a way that a second section 32 of the strip extends horizontally between rollers 43, 52 at a certain distance ($e_2$–$e_1$) above first section 31.

The strip then travels partially around upside roller 43 so as to once again leave in the "outward" direction. It is then deflected by a third upside deflecting roller 44 whose lower generating line 44*a* is placed at a height $e_3$ above bottom 11, $e_3$ being less than the depth of bath 2, the strip therefore being passed beneath surface 21 of the liquid.

The strip then returns downside to deflecting roller 53 whose lower generating line 53*a* is placed substantially at the same level e3 as upside roller 44, thus forming a third section 33 parallel to "return" section 32 and extending a certain distance $e_3$–$e_2$ above it.

After passing roller 53, the strip may be deflected by roller 52 placed on the downside and then leave the tank horizontally via an output B, passing preferably between drying rollers 16. Since the two sections 32, 33 are traveling at the same speed but in opposite directions, roller 52 may be used as a deflector on the two opposite sectors of its periphery.

It should be noted that, owing to the zigzag path of strip 3 between the upside and downside deflecting roller assemblies 4, 5, each section 31, 32, 33 of strip 3 is kept taut between the corresponding deflecting rollers along a substantially horizontal direction, the sag of each section related to the weight of the strip being negligible.

As a result, in the space of height $e_2$–$e_1$ between two superposed sections 31, 32 of strip 3, a long oblong separating wall 6 can be interposed between two superposed sections of the strip, this wall extending over the entire width of the tank and able to rest, for example, on blocks 67 fixed to side walls 12 of the tank.

In the longitudinal direction, separating wall 6 extends over substantially the entire length included between upside deflecting roller 42 and downside deflecting roller 51 and thus constitutes, with bottom 11 of the tank, a cell 63 of limited height, through which the first "outward" section 31 of the strip passes.

A second separating wall 61 can be placed at an intermediate level between "return" section 32 and "outward" section 33, this separating wall 61 extending over substantially the entire length between upside roller 43 and downside roller 52.

Preferably, a third wall 62 is placed above "return" section 33 between upside roller 44 and downside roller 53, substantially at the level of upper surface 21 of bath 2, in order to limit the risks of corrosive vapors escaping.

Separating walls 6, 61, 62 therefore divide vessel 1 into three superposed cells 63, 64, 65 of low height through which the three sections, respectively 31, 32, 33, of strip 3 pass.

In the case of FIG. 1, where bath 2 extends at least up to the level of upper wall 62, the three cells 63, 64, 65 are filled completely with liquid.

In addition, because of the tension of each strip section between the deflecting rollers, the height of each cell can be made relatively small so that when the strip is fed at high speed, a pumping action is generated that drives the liquid towards the inside of each cell.

In addition, since the ends of each separating wall 6, 61, 62 are located in the proximity of the deflecting rollers placed at the same level, each cell leads into a restricted space which constitutes an obstacle to the removal of the liquid driven along by the strip.

For example, consider lower cell 6 in which first "outward" section 31 of the strip travels. The liquid is driven at input 63*a* by the feeding of the strip and leaves at the opposite end 63*b* from a corner-shaped space defined by downside roller 51 and the strip itself. This results in an increase in pressure at output 63*b* of the cell 63 which slows down recovery of the liquid and gives rise to turbulence inside the cell, thus improving the efficiency of the pickling or degreasing treatment.

The rate at which the liquid is driven along by the strip at the input 63*a* of the cell may, however, be insufficient, and it is therefore advantageous to associate further means 7 with each cell for introducing liquid.

For this purpose, a ramp 7 can be placed at the input 63*a*, this ramp being provided with injection nozzles 70 directed towards the inside of cell 63 to assist entry of the liquid. Moreover, the side walls 12 of vessel 1 can be provided with a certain number of orifices 72 leading into the inside of cell 63, to introduce into it a certain quantity of liquid immediately carried downside by the feeding of the strip.

Moreover, according to a further particularly advantageous embodiment, a ramp of injection nozzles 71 can be placed in position at the output end 63*b*, these nozzles 71 being directed in the direction opposite to the strip feed direction so as to oppose the free evacuation of the driven liquid.

Furthermore, certain side orifices 72' can also be provided with injection nozzles directed in the opposite direction, in such a way as to set up further turbulence.

The other cells 64, 65 can be provided with similar means for introducing and/or impeding liquid in order to obtain in each one the agitation action sought.

It is thus possible to create intense agitation inside each cell, and the means used for this purpose are simpler and, above all, more efficient than in prior art arrangements.

The separating walls must, of course, be produced from an acid resistant material. For the normal width and length dimensions of a tank, it is particularly advantageous to use a material that is naturally resistant to acid, such as granite or a rock of eruptive origin, particularly from the Volvic region in France, which lends itself particularly well to this kind of application because of its excellent resistance to acid and the fact that it can be cut into relatively thin, resistant slabs.

Indeed, slabs of rock of eruptive origin can be produced over a width that is substantially equal to that of the tank, and can be simply rested on supports 74 provided along side walls 12 of the tank. Each separating wall will thus be made up of a plurality of slabs placed end to end, possibly associated with elastomer seals allowing access and maintenance.

In the example shown in FIG. 1, the bearings of the deflecting rollers are placed in position outside the acid bath and the rollers must therefore have different diameters chosen such that the lower generating line of each roller is placed at the level $e_1$, $e_2$, $e_3$ to be defined.

One possibility is to make use of totally immersed rollers, mounted so as to rotate on bearings whose elements are produced from an acid-resistant material such as a special steel, an alloy or a ceramic.

However, it is also possible to avoid immersing bearings.

Figure 3:
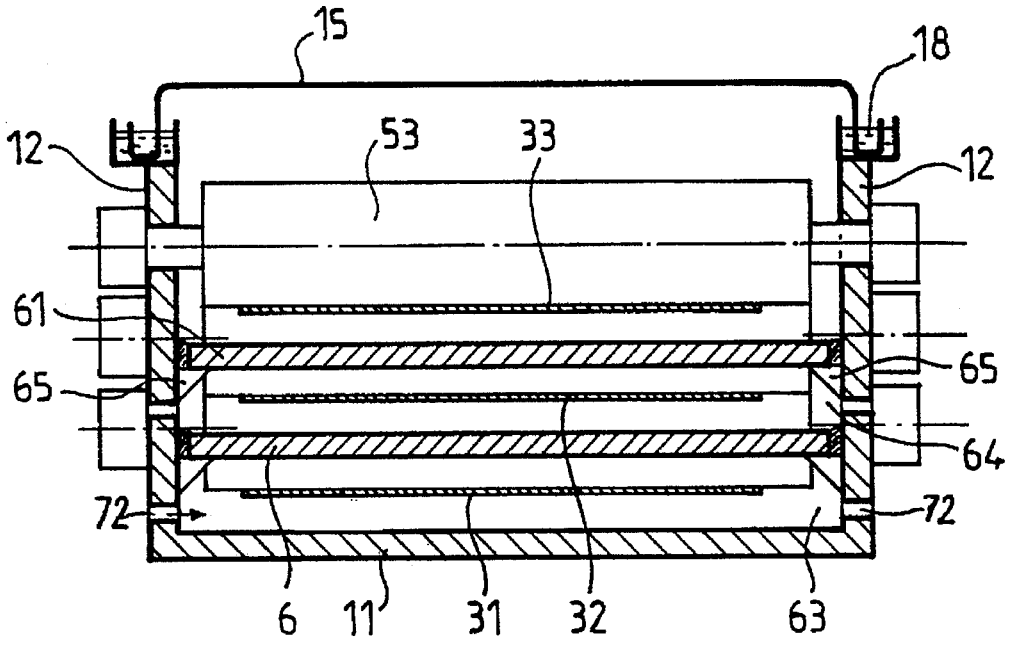
FIG. 3 is a transverse cross-sectional view along line III—III of FIG. 2.
Figure 4:
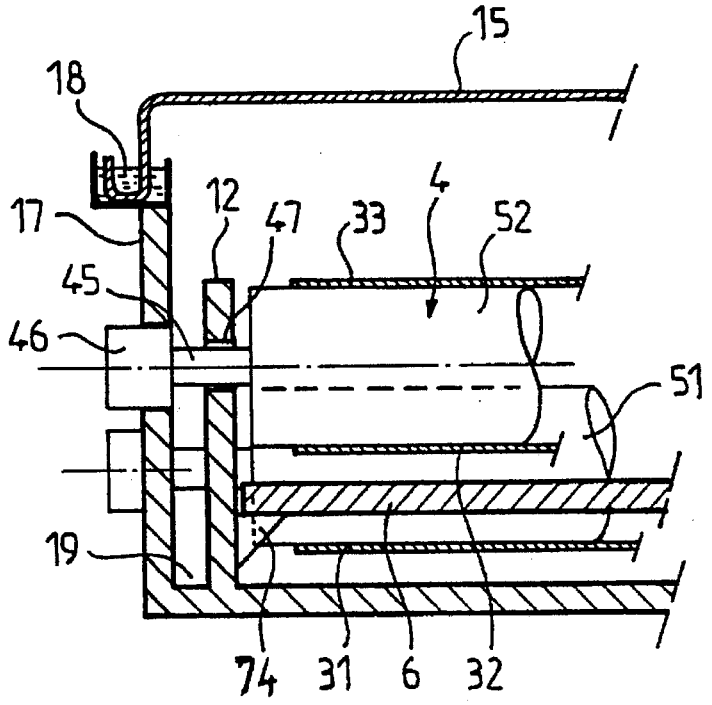
FIG. 4 is a detailed transverse cross-sectional view along line IV—IV of FIG. 2.

For example, in the embodiment shown in FIGS. 3 and 4, each roller 4 is mounted so as to rotate on a shaft whose two ends 45 pass through orifices provided in the side walls 12 of the tank and are each centered on a bearing 46 fixed onto an external wall 17 spaced slightly apart from wall 12. An annular seal 47, made of an acid-resistant material such as graphite or a ceramic, is then interposed between shaft 45 and wall 12, and any leaks of acid can be collected and evacuated to lower portion 19 of the space contained between the two parallel walls 12 and 17.

Closing cover 15 of tank 1 therefore rests on the upper edges of walls 17 which can be provided, as is customary, with a water seal 18.

However, according to a further particularly advantageous embodiment of the invention, it was discovered that the arrangements described above made it unnecessary to fill vessel 1 with a liquid bath 2, the consequence of which was to considerably reduce the risk of roller bearings becoming corroded by acid, since the strip feeds simply into several superposed cells each forming an individual tank filled with liquid and having separate means for supplying and removing liquid from the tank.

Figure 2:
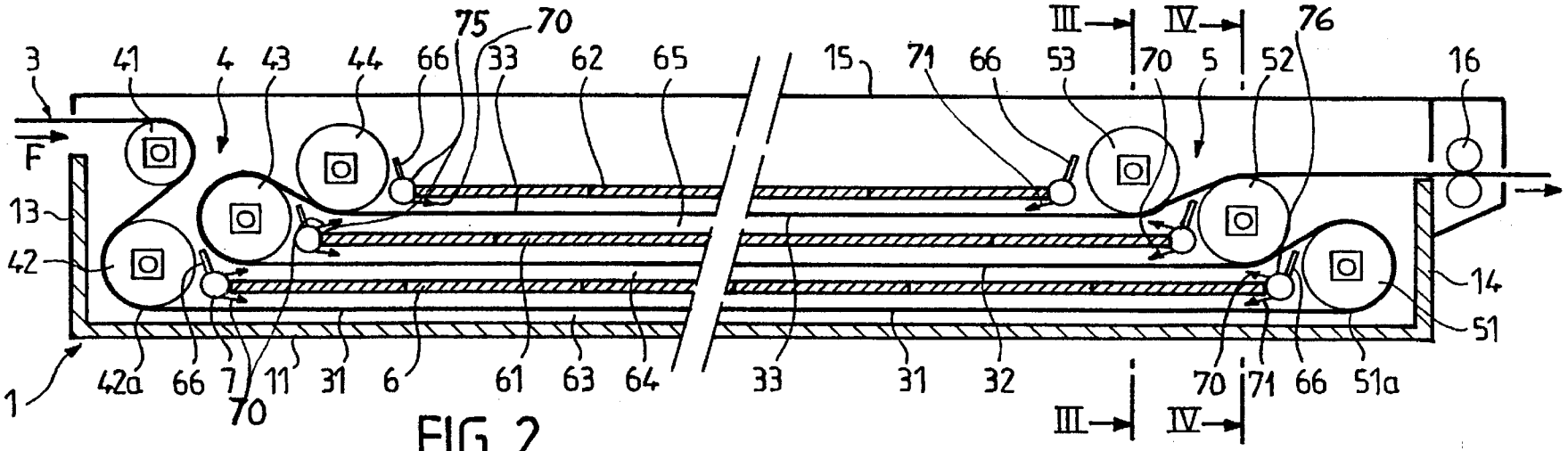
FIG. 2 is a schematic longitudinal, cross-sectional view of another embodiment of the invention.

Such a preferred embodiment is shown schematically in FIG. 2.

In this case, it can be seen that vessel 1 simply forms a supporting chassis for the deflecting rollers which is closed in a sealed fashion to collect and evacuate acid vapors and in which are arranged several separating walls 6, 61, 62 which bear upon the supports 67 fixed to the side walls 12 and which divide vessel 1 into several flat cells 63, 64, 65 in which the superposed sections 31, 32, 33 of strip 3 travel in the "outward" and "return" directions.

As previously, the liquid is introduced into each cell by injection ramps 70 placed at the input of the cell and side injection nozzles 72 traversing longitudinal walls 12 at the level of each cell 63, 64, 65 and distributed along the length of each cell.

In addition, each cell is provided with means for drawing off liquid made up of at least one orifice 73 provided in at least one of the longitudinal walls 12 and linked to a circuit comprising means for removing the liquid at a rate substantially equal to the overall supply rate to the cell.

To keep the liquid inside the cell, each end of the cell is provided with a fluid seal which does not interfere with the feeding of the strip. At the input of the cell, this seal can be formed by two ramps of injection nozzles 70 placed on either side of the strip. Similarly, at the output of the cell, two ramps of injection nozzles 71 can be fitted, the nozzles being directed towards the inside of the cell, i.e., in the direction opposite to the strip 3 feed direction.

In particular, a single collector 75, 76 can advantageously be placed at the downside and upside end, respectively, of each separating wall such as wall 61, the collector being provided with two ramps of injection nozzles 70, 71 directed towards the inside of the two cells 64, 65, placed, respectively, below and above wall 61, nozzles 70 being directed in the strip feed direction and nozzles 71 in the direction opposite to the strip feed direction.

As a result, the input of cell 64 is closed by nozzles 70 of collectors 76, placed at the downside ends in walls 6, 61, i.e., on the right of FIG. 2, and its output closed by counter-current injection nozzles 71 of collectors 75, placed at the upside ends in walls 6, 61, i.e., on the left of FIG. 2.

To provide the necessary fluid seal, the pulses from the injection nozzle ramps 70, 71, placed respectively at the input and output of each cell 63, 64, 65, are adjusted in such a way that the cells are filled with liquid but that the leakage rate, at each end, is relatively small, it also being possible to regulate pressure inside the cell by acting on the relative rates of liquid supply and removal. The pickling liquid which escapes at each end is collected in the lower portion of vessel 1 from where it can be recovered, possibly for regeneration and recirculation.

To ensure separation between the superposed cells, each separating wall 6, 61, 62 is preferably linked to longitudinal walls 12 of the tank by a seal produced from an acid-resistant material.

Each cell 63, 64, 65 therefore behaves as an individual pickling tank inside of which the treatment liquid circulates.

This permanent circulation of the liquid allows it to be quickly renewed and regenerated.

Moreover, since the height of each cell is limited, the driving of the liquid due to the feeding of the strip and the counter-current injections creates intense agitation of the liquid whose pickling efficiency is accordingly considerably improved.

It should also be noted that the association with each cell 63, 64, 65 of separate means for introducing liquid makes it possible to vary the strength of the liquid circulating in each cell, such that the different sections 31, 32, 33 of the strip 3 are subjected to the action of liquids of different strengths.

Moreover, the liquid could be made to recirculate from one cell to the next, for example in the opposite direction to the strip feeding direction, with the liquid passing via a recycling circuit allowing it to be regenerated and adjusted to the prescribed strength.

To further reduce the risks of leaks it is possible to place, at each end of walls 6, 61, 62, a short partition 66 forming an edge that extends upwardly between the rollers to at least the level of the strip section above. Each cell 63, 64, 65 therefore forms a tray whose bottom is formed by the lower separating wall 6, 61 or the bottom 11 of the tank and is thus isolated from the other cells.

While the invention has been described in relation to an acid pickling installation, any other treatment fluid could of course be used in a similar way.

I claim:

1. An installation for treating a strip product comprising:

(a) means for controlling the feeding of a strip product in a longitudinal direction F inside a vessel containing a treatment liquid;

(b) said vessel having a bottom, two longitudinal walls parallel to said longitudinal feeding direction and two transverse walls, respectively upstream and downstream in said feeding direction F, and a cover, said upstream and downstream transverse walls being respectively provided with an input and an output for said strip;

(c) an upstream deflector assembly comprising at least first and second deflecting rollers each mounted for rotation about an axis perpendicular to the longitudinal feed direction, said first roller being located adjacent said upstream transverse wall and having a lower generating line placed at a first height above said bottom of said vessel, and said second roller being offset toward the inside of said vessel and having a lower generating line placed at a second height above said bottom of said vessel, said second height being greater than said first height;

(d) a downstream deflector assembly comprising at least two deflecting rollers each mounted for rotation about an axis perpendicular to said longitudinal feed direction, respectively a first downstream roller located adjacent to said downstream transverse wall and having a lower generating line placed substantially at said first height above said bottom, and a second downstream roller having a lower generating line placed substantially at said second height above said bottom;

(e) said deflecting roller assemblies defining, inside said vessel, an outward and return path of said strip product comprising at least three superposed sections, extending respectively between said deflecting rollers, respectively a first outward section extending at a first horizontal level between said first upstream and downstream rollers, and a second return section extending between said second rollers, respectively downstream roller and upstream roller, and at least a third outward section between said second upstream roller and said output of said vessel;

(f) at least two long, oblong, substantially flat separating walls, each extending across an entire width of said vessel between said longitudinal walls, respectively at first wall extending between said first deflecting rollers, at an intermediate level between said first section and said second section of said strip, and a second wall extending between said second deflecting rollers, above said second section of said strip;

(g) said at least two separating walls dividing said vessel into at least two superposed treatment cells of limited height and respectively transversed by said first outward section and said second return section of said strip;

(h) a treatment liquid being introduced into each said cell of said vessel, at a flow rate and pressure sufficient to fill it completely.

2. The treatment installation of claim 1, comprising at least one third upstream deflecting roller and at least one third downstream deflecting roller each offset towards the inside of the vessel and having lower generating lines placed at least at a third height that is greater than the second height, and defining a horizontal path for at least a third outward section of the strip at a small distance above the second separating wall, at least a third separating wall being arranged above said third section to define at least a third cell associated with means for introducing a treatment liquid and in which said third section of the strip travels.

3. The treatment installation of claim 1, wherein the height of each treatment cell is low enough for the treatment liquid to be driven along by the feeding of the strip inside said treatment cell by a pumping action.

4. The treatment installation of claim 3, wherein the vessel contains a treatment liquid forming a bath up to a level above the level of the highest separating wall such that the inputs of all the treatment cells are immersed in said bath.

5. The treatment installation of claim 4, wherein the diameters of different rollers are determined such that the lower generating line of each roller is located at the prescribed level for each immersed section and that the axis of rotation of the roller is placed above the surface of the bath.

6. The treatment installation of claim 4, wherein each separating wall extends to within the proximity of the deflecting roller placed next to the output of said cell, so as to define a restricted space constituting an obstacle to the removal of the liquid and able to produce intense agitation, at least at the output of the cell.

7. The treatment installation of claim 3, wherein each said treatment cell is associated with means for introducing a treatment liquid inside said cell, said means comprising at least one ramp for injecting liquid under pressure, placed at least next to the input of the strip in each cell, and directed towards the inside of said cell.

8. The treatment installation of claim 7, wherein each said treatment cell is associated with means for producing a fluid seal at each end of said cell, and able to keep the liquid inside the cell without interfering with the feeding of the strip.

9. The treatment installation of claim 8, wherein the means used to produce the fluid seal at each end of each cell comprise a pair of injection ramps placed, respectively, on either side of the strip, such as to inject the treatment liquid towards the inside of said cell, the ramps placed next to the input of the strip being directed in the strip feed direction and the ramps placed next to the output of the strip being directed in the direction opposite to the feed direction.

10. The treatment installation of claim 7, wherein each cell comprises at least one orifice for recovering liquid in at least one of the longitudinal walls at the level of said cell and linked to a circuit for drawing off the liquid circulating in said cell at a rate substantially equal to the supply rate.

11. The treatment installation of any one of claims 7 to 9, wherein each cell is associated with treatment liquid injection means distributed along the two longitudinal walls at the level of each cell.

12. The treatment installation of any one of claims 7 to 9, wherein the strength of the treatment liquid introduced into each cell is adapted to the position of the cell on the path of the strip.

13. The treatment installation of any one of claims 1 to 9, wherein each separating wall is formed, at least on the surface, from material that is resistant to corrosion by the treatment liquid.

14. The installation of claim 13, wherein each separating wall is produced from a mineral material capable of being cut into slabs and which is resistant to acid.

15. The treatment installation of any one of claims 1 to 9, wherein each separating wall is connected in a substantially sealed way to the longitudinal walls of the vessel.

16. The treatment installation of claim 15, wherein each end of each separating wall is provided with edges which, together with said longitudinal walls and the separating wall, define a tray for holding and recovering the liquid contained in the corresponding cell.

17. The treatment installation of claim 4, wherein the two longitudinal walls of the vessel are each associated with an external wall separated from the wall by a leak recovery space, each deflecting roller being mounted so as to rotate on a shaft having two ends which pass into orifices in the longitudinal walls of the vessel with the interposition of an annular seal, and are centered on bearings supported by said external walls.

* * * * *